US006041631A

United States Patent [19]

Vonlanthen

[11] Patent Number: 6,041,631

[45] Date of Patent: Mar. 28, 2000

[54] LOCKING DEVICE WITH A CYLINDER LOCK AND A FLAT KEY

[75] Inventor: Benno Vonlanthen, Zollikofen, Switzerland

[73] Assignee: R. Berchtold AG, Zollikofen, Switzerland

[21] Appl. No.: 09/091,093

[22] PCT Filed: Dec. 11, 1995

[86] PCT No.: PCT/CH95/00297

§ 371 Date: Jun. 11, 1998

§ 102(e) Date: Jun. 11, 1998

[87] PCT Pub. No.: WO97/21895

PCT Pub. Date: Jun. 19, 1997

[51] Int. Cl.[7] ..... E05B 27/00

[52] U.S. Cl. ..... 70/492; 70/413; 70/495; 70/419

[58] Field of Search ..... 70/492, 413, 409, 70/493, 276, 495, 494, 419

[56] References Cited

U.S. PATENT DOCUMENTS

| | | | |
|---|---|---|---|
| 1,965,889 | 7/1934 | Gerald | 70/419 |
| 3,264,852 | 8/1966 | Gysin | 70/492 |
| 3,566,637 | 3/1971 | Hallmann | 70/276 |
| 3,665,740 | 5/1972 | Taniyama | 70/276 |
| 3,999,413 | 12/1976 | Raymond et al. | 70/364 R |
| 4,270,372 | 6/1981 | Vonlanthen et al. | 70/406 |
| 4,712,399 | 12/1987 | Mattossovich | 70/364 A |

FOREIGN PATENT DOCUMENTS

| | | |
|---|---|---|
| 2572117 | 4/1986 | France . |
| 3129577 | 8/1982 | Germany . |

OTHER PUBLICATIONS

Translation of Preliminary International Examination Report.

*Primary Examiner*—B. Dayoan
*Assistant Examiner*—John B. Walsh
*Attorney, Agent, or Firm*—Notaro & Michalos P.C.

[57] ABSTRACT

The cylinder lock comprises blocking tumblers which are guided parallel to the broad sides of the key channel. On the broad sides (13, 14) of the flat key (2) guide grooves (15, 16) are disposed which cooperate with carriers on the blocking tumblers. The grooves (15, 16) on the key (2) comprise several function regions, wherein a subregion (51) of the groove comprises an expanded groove width. The tumblers whose carriers engage these expanded groove regions (51) are equipped with additional positioning elements. This configuration prevents the unauthorized opening of a lock according to the invention with a key (2) with duplicated guide grooves (15, 16).

7 Claims, 3 Drawing Sheets

LOCKING DEVICE WITH A CYLINDER LOCK AND A FLAT KEY

FIELD AND BACKGROUND OF THE INVENTION

The invention relates to a locking device with a cylinder lock and a flat key, wherein the cylinder lock comprises a rotor, rotatable in a stator, with a key channel and guides with tumblers, which guides are disposed substantially at right angles to the longitudinal axis of the rotor and parallel to the broad sides of the key channel, these tumblers being provided with carriers which project into the key channel, and the flat key comprises on each broad side at least one guide groove which the carriers of the tumblers engage and the flat key and at least one of the tumblers comprise magnetic elements.

Such a locking device with a cylinder lock and a flat key is known from U.S. Pat. No. 3,264,852 or EP-B 0 008 310/Therein on a turning flat key on that portion which is inserted into the lock, guide grooves are disposed on both broad sides. These guide grooves extend in a curve and form guides and positioning regions for carriers, which are a part of the blocking tumblers in the lock. The blocking tumblers are supported in guides of the rotor in the lock, wherein these guides extend approximately at right angles to the lock axis and parallel to the broad sides of the key channel. The blocking tumblers are freely movable in the guides and not spring-loaded. When the lock is blocked the ends of the blocking tumblers engage bores in the stator and penetrate thus the dividing and shearing face between rotor and stator on the lock. The carriers, projecting into the key channel, of the blocking tumblers have the same dimensions as the guide grooves on the key. They are thus force-guided in both directions which permits the precise positioning of the blocking tumblers, with the aid of the guide grooves, in the unlocking position. When the key is inserted into the key channel, the carriers follow the curve track of the guide groove, and the tumblers are displaced in their guides until they have reached the unlocking positions when the key is completed inserted. In the case of turning flat keys on each broad side of the key two guide grooves are disposed, wherein normally only one groove on each broad side cooperates with carriers on the lock. The second groove goes into action if the key is rotated by 180° when the key is to be inserted into the key channel after it is rotated by 180°. With the aid of small machine tools it is possible to copy precisely the dimensions of the keys used in these known locking devices and also to copy the guide grooves on the broad sides precisely. Such machine tools have found widespread use in service centers as special machine, whereby it becomes relatively simple to have keys copied. Therewith the danger is increased that unauthorized persons obtain an original key, have a copy made of it, and subsequently the owner of the original key has no knowledge of the availability of a key copy. With this key copy the locking device can subsequently be opened without action or force or other measures becoming necessary. In locking systems with a large number of locks and keys, the danger also exists that by copying original keys duplicate keys can be made which do not have the necessary precision. Thereby the lock is damaged and the locking function may be disturbed. Such copied keys cannot be readily detected by the user and therefore cannot be eliminated from the system.

From FR-A-2 572 117 is known a locking device of the above-described type which comprises at least one tumbler whose carriers in the direction of the groove width on the key have a dimension which is less than the width of the groove. For the remainder the guide groove on the key has the same width over the entire length. In order to bring the tumbler with reduced dimension into the unlocking position, a magnet is disposed on the key and the carrier or a portion of the tumbler is formed of magnetic material. Through the force of the magnet on the key the carrier is pulled or pressed against one of the side faces of the guide grooves on the key and therewith the tumbler is secured in the unlocking position. The actuation of such a key device by means of a duplicated key is made difficult, but is nevertheless successful in many cases. By applying an additional magnetic force from the outside, the tumbler in every case can be correctly positioned with the magnetic carrier and the lock can be unlocked. This key device also may for this reason not yet meet increased requirements of duplication protection of the keys and the security of such key devices.

SUMMARY OF THE INVENTION

It is the task of the present invention while retaining the system described in U.S. Pat. No. 3,264,852 of non-springloaded blocking tumblers to create a capability of uncoupling the positioning of the tumblers in the unlocking position of the lock from the form of the guide grooves on the key. In addition, possibilities are to be created such that a direct identical copying of the grooves is insufficient alone to open the lock with a duplicated key. Copying the keys and thus the opening of locking devices with copied keys is made more difficult.

This task is solved through the characteristics defined in the characterizing clause of patent claim 1, Advantageous further developments of the invention are evident based on the characteristics of the dependent claims.

In the locking device according to the invention, when the flat key is inserted completely into the key channel, at least one of the tumblers is not held through the guide position in the unlocking position. An additional positioning element is present which positions this tumbler in the unlocking position and holds it there. This additional positioning element yields the advantage that the carriers connected with the blocking tumblers no longer need to be force-guided in each case by the guide groove on the key. The grooves on the key therefore comprise expanded regions in which between the side walls of the grooves and the carrier interspaces exist. When the key is inserted completely, at least one carrier is located in this expanded region of a groove and the blocking tumbler must therefore be positioned in the region through the additional positioning element and the carrier is not guided by the side walls of the key groove. If this positioning element is absent, the tumbler cannot be brought into the unlocking position, i.e. the lock cannot be opened. This is also the case if the key comprises precisely copied guide grooves, but the lock, respectively the key, does not have the additional positioning element. This leads to the fact that the use of copied keys with guide grooves on the broad sides is made considerable more difficult. If the additional positioning element is formed of a permanent magnet disposed in the key bit and a magnetic element disposed in the tumbler, the corresponding magnet body on the key must also be copied. This copying is however not possible on conventional copying machines. A further advantage comprises that the second additional positioning element can be formed by an additional coding on the rear side of the tumblers and an associated two-part blocking element. This coding permits the positioning of the carrier of the tumbler in an expanded region of a guide groove on the key without the carrier being in contact with the side faces of the groove. This configuration permits an additional obscuring of the opening positions of the blocking tumblers and makes difficult recognizing the interactive functions between the key according to the invention and the cylinder lock. In the configuration of at least one additional positioning element with a magnet connection, and at least one second additional positioning element with a coding on the rear side of the tumblers. A combination is attained in which the cylinder lock cannot be unlocked with a copied key even when applying additional magnet forces or other measures for cracking the lock. It is not possible to detect on the key whether or not to an expanded region of the guide groove a tumbler with a magnetic positioning element or a tumbler with a second positioning element on the rear side is assigned. Therewith the security of the locking device according to the invention is also improved.

In the following the invention will be explained in further detail in conjunction with embodiment examples with reference to the enclosed drawings. Therein depict:

DESCRIPTION OF THE PREFERRED EMBODIMENT

Figure 1:
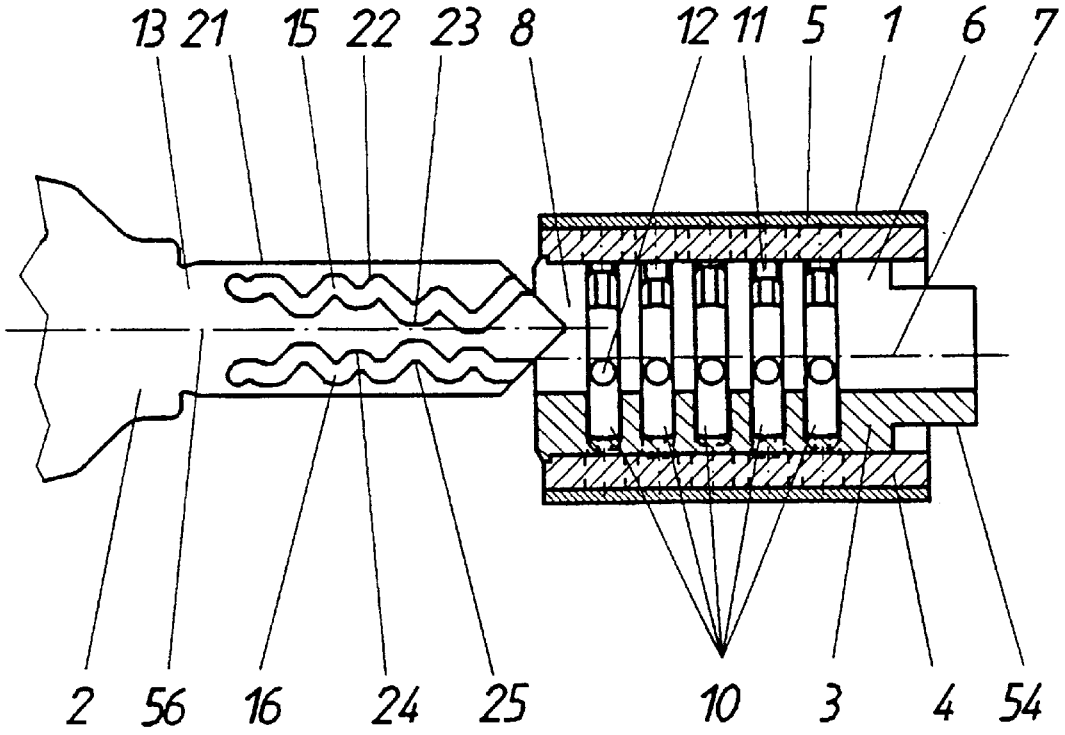
FIG. 1 a longitudinal section through a lock according to prior art, and a lock in simplified representation, FIG. 2 a cross section through a locking device according to the invention, with the additional positioning elements, FIG. 3 a side view of a key with grooves implemented according to the invention and inserted permanent magnets.

The locking device depicted in FIG. 1 comprises a cylinder lock 1 and a flat key 2, in the example shown a flat turning key. It substantially corresponds to prior art according to U.S. Pat. No. 3,264,852. The cylinder lock 1 is shown in simplified form and comprises a rotor 3 which is rotatable in a stator 4 and a sleeve 5 which encompasses the entire cylinder lock 1 as a jacket. Into the rotor 3 is worked a key channel 6 with a rectangular cross section. Into this key channel 6 the key bit 21 of the key 2 is insertable. Into the broad sides 13, 14 of the flat turning key 2 guide tracks 15, 16 are milled in the form of grooves which serve for positioning the locking elements in the cylinder lock 1. Since the key 2 is a turning key, on the non-visible broad side 14 the groove 15 is at the bottom and the groove 16 at the top. With respect to the center axis 56 of the key 2 thus identically formed grooves 15, respectively 16, are diagonally opposing one another on the two broad sides 13, 14. In the example depicted rotor 3 on each broad side 8, 9 of the key channel 6 five tumblers 10 are disposed such that ten locking elements result. These tumblers 10 are supported in guides 11 of rotor 3 and are displaceable transversely to the longitudinal axis 7 of lock 1. At the rear end 54 of rotor 3 coupling elements, not shown but known, are available which cooperate with locking elements, also not shown, for example a door lock.

Figure 2:
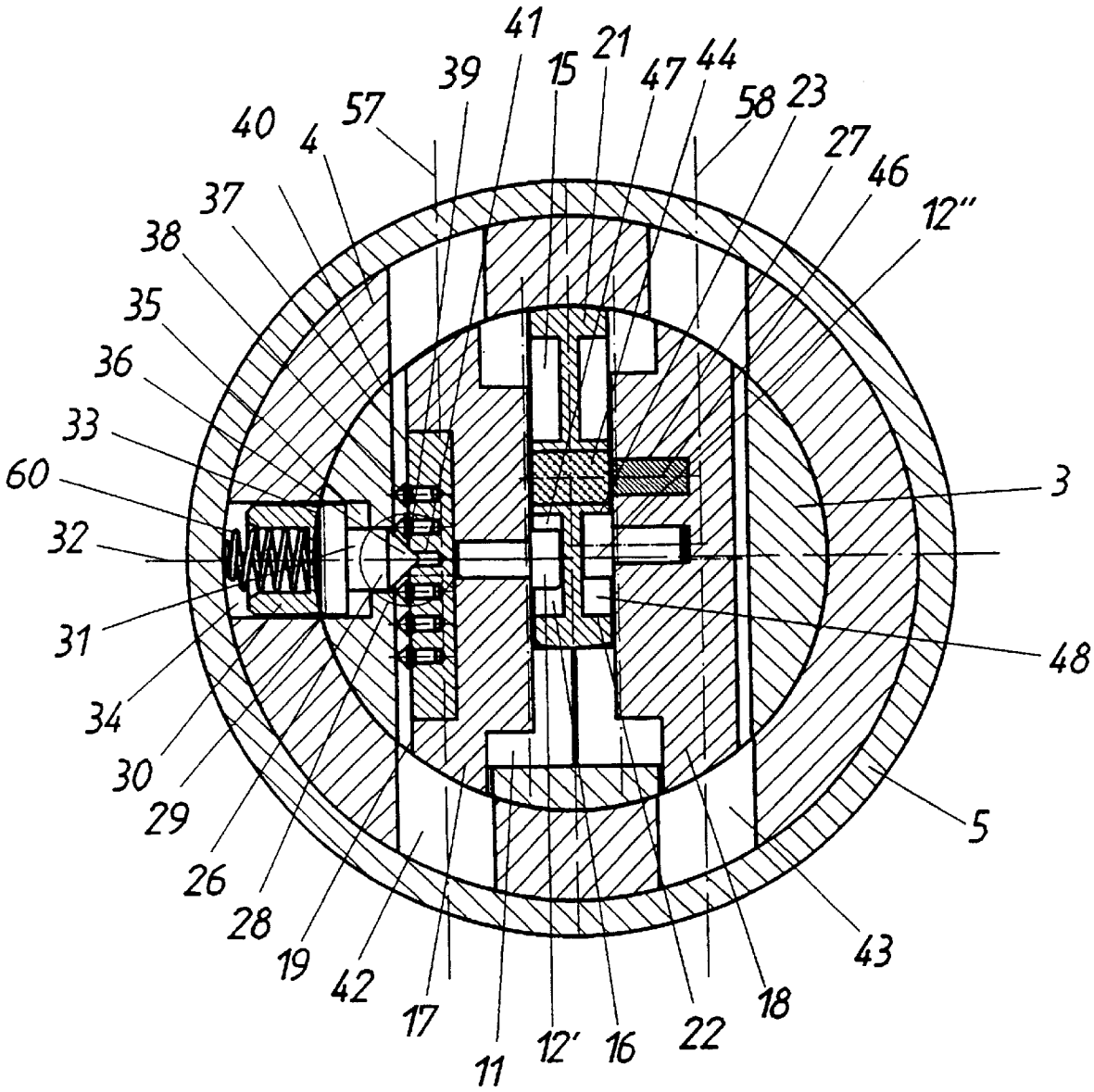

FIG. 2 shows a cross section through a cylinder lock 1 and specifically in the region of two guides 11 disposed on both sides of the key channel 6. In these two guides 11, however, are not disposed standard tumblers 10 according to FIG. 1 but rather tumblers 17 and 18 modified according to the invention. In the position shown of rotor 3 in the stator 4 the guides 11 cooperate with bores 42, 43 in stator 4 such that the tumblers 17, 18 shown as well as potential further tumblers 10 can be displaced in the direction of axes 57, 58. In this position of the rotor thus the key 2 can be pulled from the key channel 6 or inserted into it. The carriers 12, 12', 12" connected with tumblers 17, 18, respectively 10, follow the course of the guide grooves 15 and 16 on the broad sides 13 and 14 of key 2, and the ends of the tumblers 17, 18, respectively 10, can extend into the regions of bores 42, 43. With the key pulled off, the ends of tumblers 17, 18, respectively 10, engage the bores 42 and 43 in stator 4 and block the rotor 3 against rotations. In the position, shown in FIG. 2, of tumblers 17 and 18 the rotor 3 can be rotated in stator 4, i.e. the tumblers 17, 18 are in their unlocking position since no end projects beyond the shear line 40 between rotor 3 and stator 4. The further tumblers 10 disposed in lock 1 are also in their unlocking position and in these tumblers 10, not shown in FIG. 2, the carriers 12 are guided by guide grooves 15, 16 on key 2 and are positioned by the guide groove regions. The carriers 12 of tumblers 10 are therein in contact with the side walls 22, 23 of grooves 15, respectively the side walls 24, 25 of grooves 16 in contrast to the carriers 12' and 12" which are free of contact.

The grooves 15, 16 on the broad sides 13, 14 of the lock bit 21 comprise different function regions. In the sectional region, shown in FIG. 2, of the key bit 21 the width of grooves 15, 16 is expanded and forms a so-called free region 51. In this expanded free region 51 of grooves 15, 16 the width of grooves 15, 16 is greater than the dimension of carriers 12', respectively 12". Between the carriers 12', respectively 12", engaging the grooves 15, 16 and the two side walls 22, 23 of groove 15, respectively 24, 25 of groove 16, an interspace 47, respectively 48, is formed. The carriers 12' and 12" are therefore not guided in this expanded free region of grooves 15, 16 by means of the grooves themselves but rather additional positioning elements 26, 27 are necessary in order to secure the tumblers 17 and 18 in the unlocking positions.

A first possibility for forming an additional positioning element is shown on the right side of FIG. 2 in conjunction with tumbler 18. Along with the carrier 12' in the tumbler 18 a magnetic element 46 is disposed which cooperates with a permanent magnet 44 built into the key bit 21. In the example shown, the permanent magnet 44 on the key bit 21 draws the magnetic element 46 in the tumbler 18 upwardly, until the axes of the magnets 44 and 46 are disposed in the same plane. The permanent magnet 44 and the magnetic element 46 cooperate such. The permanent magnet 44 and the magnetic element 46 that the permanent magnet 44 holds the tumbler 18 over the magnetic element 46 in a predetermined position without the carrier 12" touching one of the side walls 22, 23 of the guide groove 15. For this purpose in the guide groove 15 a prepositioning region is disposed which when the key 2 is being slid into the key channel 6, brings the tumblers into the unlocking position, and subsequently, when changing into the succeeding free region 51 of groove 15 the permanent magnet 44 holds and secures the tumblers 18 in this unlocking position. In this position the tumbler 18 is precisely secured in the unlocking position. If on key bit 21 no permanent magnet 44 were present, the tumbler 18 would fall downwardly until the carrier 12" came to rest on the side wall 22 of groove 15. In this position the lower end of tumbler 18 would engage the bore 43 and rotor 3 would be blocked against rotation in stator 4. In this embodiment the tumbler 18 blocks the rotor 3 against the stator 4 even if on key bit 21 the permanent magnet 44 is not positioned correctly. In this embodiment the tumbler 18 also blocks the rotor 3 relative to the stator 4 if on the key bit 21 the permanent magnet 44 is not present or is not positioned correctly.

The possibility for forming an additional position element is shown on the left half of FIG. 2 in respect to the tumbler 17. As a supplement to the first positioning element 27 is disposed between tumbler 17 and stator 4 in the embodiment according to the invention of lock 1 a second additional positioning element 26 with a blocking element 29. This blocking element 29 is a two-part element and comprises a first part 30, supported in a bore 34 in stator 4, and a second part 31 supported in a bore 35 in rotor 3. In the opening position shown of lock 1, respectively in the position of rotor 3 in stator 4, in which the key 2 can be pulled off, the axes 32 of the two bores 34 and 35 coincide. In this position the two bores 34 and 35 form a common guide bore in which the blocking element parts 30 and 31 can be moved back and forth between stator 4 and rotor 3. The first blocking element part 30 is implemented in the form of a pot and is pushed by a compression spring 60 in the direction of the tumbler 17. The second blocking element part 31 comprises a shoulder which cooperates with the offset of the step bore 35. Between the two blocking element parts 30 and 31 is formed a dividing face 33 along which the two parts 30 and 31 can be displaced relative to one another. The offset end 36 directed toward the longitudinal axis 7 of lock 1, of the second blocking element part 31 is in contact on the rear side 19 of tumbler 17. As rear side 19 of tumbler 17 is considered that side of tumbler 17 which is facing away from the key channel 6. This rear side 19 is equipped with a positioning face 37 in which codings 28 are disposed in the form of hollows 39 and peaks 38. The end 36 is formed corresponding to the slope forms of the hollows 39 and in the example shown tapers into a point. If the tumbler 17 is displaced in the direction of its longitudinal axes 57, respectively parallel to the broad sides 8, 9 of the key channel 6, the end 36 of the second blocking element part 31 snaps into the hollows 39 or between the peaks 38. The hollow next to the outermost peak 38 in the positioning face 37 of the tumbler 17 holds therein the tumbler 17, after the key 2 is pulled from lock 1, in the blocking position in which one end of tumbler 17 engages bore 42 of stator 4. The tumbler 17 shown in FIG. 2 is shown in the opening position, which means, it engages with none of the two ends the bore 42 in stator 4. Tumbler 17 is maintained in this position via bore 41, respectively the hollow 39 via the second blocking element 31. The dividing face 33 between the two blocking element parts 30 and 31 are therein disposed on the shear line 40 between rotor 3 and stator 4. If none of the other tumblers 10, 18 engage a bore 42, 43 of stator 4, the rotor 3 can be rotated. In the unlocking position shown of tumbler 17 the carrier 12' is also in a free region 51 with expanded width of groove 16. The tumbler 17 is brought into the unlocking position shown through a prepositioning region disposed directly in front of free region 51 of groove 16 and held in this position through the additional positioning element 26 with the blocking element 29. For securing the tumbler 17 in the unlocking position consequently no permanent magnet is necessary but this securing takes place through the second additional positioning element 26 on the rear side 19 of tumbler 17. This disposition of a second additional positioning element 26 is preferably disposed in addition to a positioning element 27 with magnet positioning, as shown on the right side of FIG. 2. Consequently, it becomes extremely difficult to recognize, based on the key, how the lock is coded and which of the tumblers are held in the unlocking positions via additional magnet positionings. This cannot be determined by the expanded free regions 51 of grooves 15, 16 on key 2 since with the key 2 completely inserted these free regions 51 can also be engaged by carriers 12' of tumblers 17, which can be equipped with an additional positioning element 26, as shown on the left side of FIG. 2.

Figure 3:
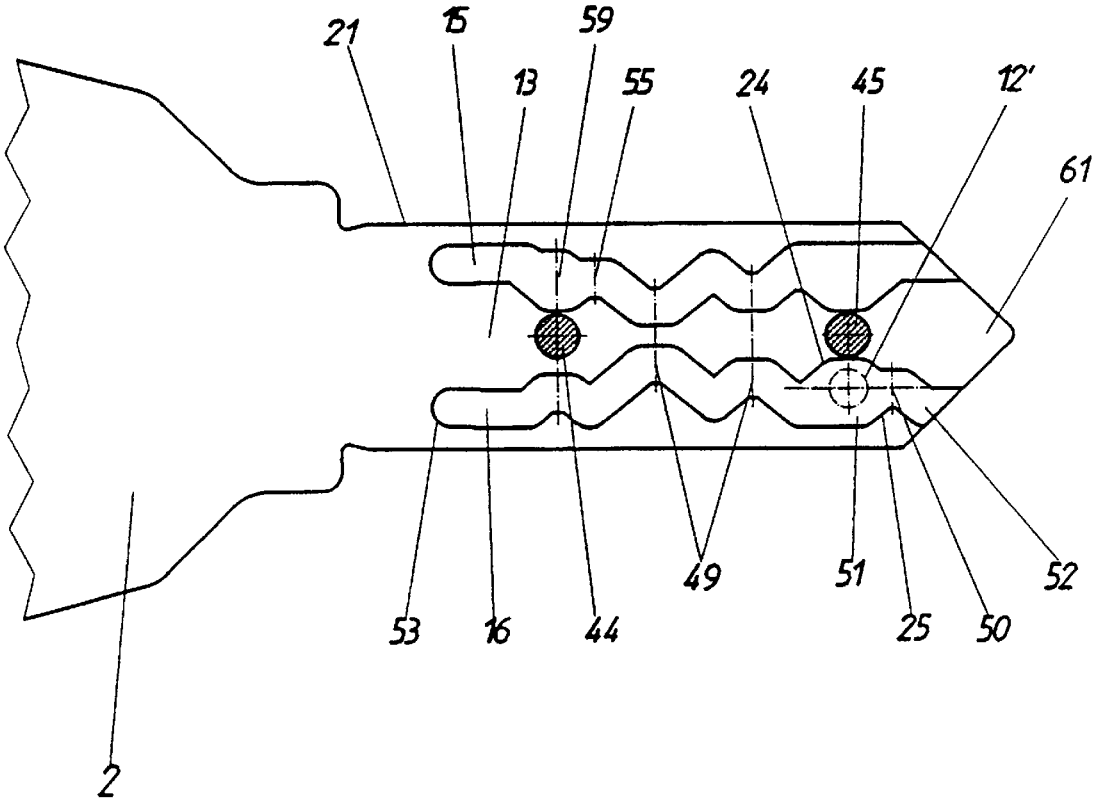

FIG. 3 shows the key bit 21, equipped according to the invention, of a flat key 2. Since this key is a turning flat key on the non-visible broad side 14 of the key 2 the guide groove 15 is disposed below and the guide groove 16 above. The details of the two guide grooves 15, 16 can therefore also be explained using the visible broad side 13 since they are implemented identically on the front and rear broad side 13, respectively 14. The guide grooves 15, 16 comprise over their length from beginning 52 on the tip 61 of key 2 to its end 53 different function regions. In the example shown these are positioning regions 49, prepositioning regions 50, 55 as well as free regions 51, 59. In the positioning regions 49 and the prepositioning regions 50 the width of grooves 15, 16 corresponds to the dimensions of carriers 12, 12' and 12" which engage these grooves 15, 16. In the free regions 51, 59 the width of grooves 15, 16 is expanded, i.e. it is greater than the dimensions of carriers 12, 12' and 12". In the case of the free region 51 of groove 16 one carrier 12' is indicated in dot-dash line, and it can be seen that in this free region 51 the carrier 12' touches neither the side wall 24 nor the side wall 25. Between carrier 12' and at least one of the side walls 24, 25 is disposed an interspace. In front of each of the expanded free regions 51 of guide groove 16, respectively 59 of groove 15, viewed from the beginning 52 of the guide grooves 15, 16, is disposed a prepositioning region 50, respectively 55. In this prepositioning region 50, respectively 55, the carriers 12, 12' and 12" are brought into the unlocking position and subsequently secured through the additional positioning elements 26 or 27, described in connection with FIG. 2. In the key 2 shown in FIG. 3 between the guide grooves 15, 16 are disposed two permanent magnets 44 and 45, and only the rear permanent magnet 44 positions a tumbler 18 with a magnetic element 46. The tumbler 18 is therein disposed parallel to the broad side 14 of key 2. The permanent magnets 44, 45 are advantageously disposed so as to be hidden such that their positioning in the key bit 21 cannot be detected visually. The material of key 2 in known manner is not magnetic with hard brass being often used. The keys equipped according to the invention have characteristic forms of grooves 15, 16 which differ from the groove forms on keys of this type used previously. If magnets 44, 45 are disposed so as to be visible, additional differentiation characteristics result. The precise copying of grooves 15, 16 however, does not yield a key 2 which makes possible opening a lock 2 equipped according to the invention with additional positioning elements 26, 27. Therewith the unauthorized duplication of keys of this type is made considerably more difficult since additionally the magnets must also be disposed at the correct location and in the correct manner. However, with the currently available machine tools it is not possible and requires considerable additional expenditures. Consequently, increased security of corresponding locking systems can be attained since unauthorized duplicates of keys can only be produced with considerable expenditures. Simultaneously, lock/key systems of the type according to the invention can be equipped with improved tumblers 17 which have on the rear side 19 additional codings 28. This provides additional coding possibilities on lock and key which additionally makes duplication more difficult.

I claim:

1. A locking device comprising:

a cylinder lock (1) and a flat key (2);

the cylinder lock (1) comprising a stator (4) and a rotor (3) with a longitudinal axis (7), the rotor being mounted for rotation in the stator (4) with a shear (40) line between the rotor and the stator;

the rotor (3) having a key channel (6) with broad sides (8), a plurality of guides (11), a plurality of tumblers (10) each mounted in one of the guides and disposed substantially at right angles to the longitudinal axis (7) of the rotor (3) and parallel to the broad sides (8) of the key channel (6), each of the tumblers (10) having a carrier (12) which project into the key channel (6);

the flat key (2) having a bit (21) with opposite sides (13,14), each of the opposite sides having at least one guide groove (15,16) for engaging the carriers of at least some of the tumblers when the key is inserted into the key channel (6), the at least one guide groove (15,16) on one of the opposite sides of the key bit having at least one free region (51), the free region having two side walls (22,23,24,25) and an expanded groove width so that with the key bit (21) inserted completely into the key channel (6) one of the carriers (12") is disposed in an unlocking position in the free region (51) and is out of contact with both said two side walls so that there is an interspace (47,48) between said one of the carriers (12") and the two side walls (22, 23,24,25) in said free region;

a permanent magnet (44,45) in the key bit; and a magnetic element (46) in one of said tumblers (18) which carries said one of the carriers in the free region, the magnetic element cooperating with the permanent magnet to form an additional positioning element (27) through which said one tumbler (18) which carries said one of the carriers, is positioned in the unlocking position that is free of contact with the side walls in said free region;

the remaining carriers which are other than said one of the carriers that is in said free region, being in contact with the side walls (22,23,24,25) of said grooves (15,16) to form unlocking positions for the tumblers of said remaining carriers.

2. A locking device as claimed in claim 1, wherein one of said tumblers comprises a second tumbler (17), said second tumbler (17) having an additional positioning element (26), said additional positioning element (26) comprising a coding (28) on a rear side (19) of said second tumbler (17) and a two-part blocking element (29), said blocking element (29) being between the rear side (19) of said second tumbler (17) and the stator (4) and being displaceable on a blocking element axis (32) which is approximately at right angles to the longitudinal axis (7) of the rotor (3).

3. A locking device as claimed in claim 2, wherein the blocking element (29) comprises a first part (30) and a second part (31) with a dividing face (33) between said first part and said second part, the stator (4) having a stator bore (34), said first part (30) of the blocking element (29) being supported for displacement in said stator bore (34), the rotor (3) having a rotor bore (35), said second part (31) being supported for displacement in said rotor bore (35), the stator bore and the rotor bore both lying on said blocking element axes (32) in a blocking position of the cylinder lock (1), said second part (31) of the blocking element (29) having an end (36) extending toward the longitudinal axis (7) of rotor (3) and in contact with the rear side (19) of said second tumbler (17), the coding (28) on the rear side (19) of said second tumbler (17) comprising a positioning face (37) with several additional codings (38, 39) for establishing blocking and opening positions of the additional positioning element (26), and with a selected positioning of the end (36) of the second part (31) in one of said additional codings on the rear side (19) of the second tumbler (17), the dividing face (33) between the first part and the second part (30, 31) coincides with the shear line (40) between the rotor (3) and the stator (4).

4. A locking device as claimed in claim 3, wherein the additional codings in the positioning face (37) on the rear side (19) of said second tumbler (17) comprise hollows (39) or peaks (38) or a combination of hollows (39) and peaks (38).

5. A locking device as claimed in claim 1, wherein said at least one groove (15,16) has a beginning (52), an end (53), at least one positioning region (49) and a least one prepositioning region (50), the positioning and prepositioning regions having widths substantially corresponding to widths of the carriers, the at least one prepositioning region (50) being between the beginning of said at least one groove and said free region (51).

6. A locking device as claimed in claim 1, wherein said at least one groove (15, 16) comprises different positioning regions (49) and prepositioning regions (50, 55) with a predetermined groove width, as well as at least said one free region (51) with said expanded groove width, and in a direction from a beginning (52) toward an end (53) of the at least one groove (15, 16), before each free region (51), a prepositioning region (50, 55) is disposed.

7. A locking device as claimed in claim 6, wherein, other that for said permanent magnet, the key is made of non-magnetic material.

* * * * *